US010760342B2

(12) United States Patent
Hinz et al.

(10) Patent No.: US 10,760,342 B2
(45) Date of Patent: Sep. 1, 2020

(54) ROLLING ELEMENT ASSEMBLY WITH A COMPLIANT RETAINER

(71) Applicant: Halliburton Energy Services, Inc., Houston, TX (US)

(72) Inventors: Brandon James Hinz, Conroe, TX (US); Gregory Christopher Grosz, Magnolia, TX (US); Seth Garrett Anderle, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 6 days.

(21) Appl. No.: 16/329,329

(22) PCT Filed: Oct. 5, 2016

(86) PCT No.: PCT/US2016/055513

§ 371 (c)(1),
(2) Date: Feb. 28, 2019

(87) PCT Pub. No.: WO2018/067142

PCT Pub. Date: Apr. 12, 2018

(65) Prior Publication Data

US 2019/0249498 A1 Aug. 15, 2019

(51) Int. Cl.

| | |
|---|---|
| ***E21B 10/43*** | (2006.01) |
| ***E21B 10/54*** | (2006.01) |
| ***E21B 10/633*** | (2006.01) |
| *E21B 10/567* | (2006.01) |

(52) U.S. Cl.

CPC ..... *E21B 10/43* (2013.01); *E21B 10/54* (2013.01); *E21B 10/633* (2013.01); *E21B 10/567* (2013.01)

(58) Field of Classification Search

CPC ..... E21B 10/43; E21B 10/54; E21B 10/567; E21B 10/633; E21B 2010/425

See application file for complete search history.

(56) References Cited

U.S. PATENT DOCUMENTS

| | | | |
|---|---|---|---|
| 4,006,788 | A | 2/1977 | Garner |
| 4,343,371 | A | 8/1982 | Baker, III et al. |
| 4,553,615 | A | 11/1985 | Grainger |
| 4,751,972 | A | 6/1988 | Jones et al. |

(Continued)

FOREIGN PATENT DOCUMENTS

| | | |
|---|---|---|
| GB | 1239074 | 7/1968 |
| WO | 2013085869 | 6/2013 |

OTHER PUBLICATIONS

ISRWO International Search Report and Written Opinion for PCT/US2016/055513 dated Jun. 26, 2017.

*Primary Examiner* — David Carroll
(74) *Attorney, Agent, or Firm* — Thomas Rooney; C. Tumey Law Group PLLC

(57) ABSTRACT

A rolling element assembly includes a rolling element rotatable about a rotational axis when positioned within a cavity defined on a bit body of a drill bit, and a compliant retainer positioned within a retainer slot defined in the bit body. A biasing device is positioned within a device pocket defined within the bit body to bias the compliant retainer against the outer circumferential surface of the rolling element. The compliant retainer secures the rolling element within the cavity while an arcuate portion of the rolling element protrudes from the cavity and exposes a full axial width of the rolling element.

20 Claims, 6 Drawing Sheets

(56) References Cited

U.S. PATENT DOCUMENTS

| | | | | |
|---|---|---|---|---|
| 5,339,910 | A | 8/1994 | Mueller | |
| 6,298,930 | B1 | 10/2001 | Sinor et al. | |
| 6,460,631 | B2 | 10/2002 | Dykstra et al. | |
| 6,779,613 | B2 | 8/2004 | Dykstra et al. | |
| 6,935,441 | B2 | 8/2005 | Dykstra et al. | |
| 7,096,987 | B2 | 8/2006 | Moen et al. | |
| 7,703,559 | B2 | 4/2010 | Shen et al. | |
| 7,762,359 | B1 | 7/2010 | Miess | |
| 7,814,997 | B2 | 10/2010 | Aliko et al. | |
| 8,079,431 | B1 | 12/2011 | Cooley et al. | |
| 8,091,655 | B2 | 1/2012 | Shen et al. | |
| 8,141,665 | B2 | 3/2012 | Ganz | |
| 8,286,735 | B1 | 10/2012 | Cooley et al. | |
| 8,413,746 | B2 | 4/2013 | Shen et al. | |
| 8,459,378 | B2 | 6/2013 | Zahradnik et al. | |
| 8,459,382 | B2 | 6/2013 | Aliko et al. | |
| 8,499,859 | B1 * | 8/2013 | Cooley | E21B 10/633 175/382 |
| 8,678,111 | B2 | 3/2014 | Zahradnik et al. | |
| 2008/0017419 | A1 * | 1/2008 | Cooley | E21B 10/62 175/286 |
| 2010/0219001 | A1 | 9/2010 | Shen et al. | |
| 2010/0276200 | A1 | 11/2010 | Schwefe et al. | |
| 2012/0132471 | A1 | 5/2012 | Zhang et al. | |
| 2013/0140094 | A1 | 6/2013 | Burhan et al. | |
| 2013/0220707 | A1 | 8/2013 | Shen et al. | |
| 2013/0248260 | A1 | 9/2013 | Ganz | |
| 2014/0360792 | A1 * | 12/2014 | Azar | E21B 10/5735 175/432 |
| 2016/0153243 | A1 | 6/2016 | Hinz et al. | |

* cited by examiner

ROLLING ELEMENT ASSEMBLY WITH A COMPLIANT RETAINER

BACKGROUND

In conventional wellbore drilling in the oil and gas industry, a drill bit is mounted on the end of a drill string, which may be extended by adding segments of drill pipe as the well is progressively drilled to the desired depth. At the surface of the well site, a rotary drive (referred to as a "top drive") may be provided to rotate the entire drill string, including the drill bit at the end, to drill through the subterranean formation. Alternatively, the drill bit may be rotated using a downhole mud motor without having to rotate the drill string. When drilling, drilling fluid is pumped through the drill string and discharged from the drill bit to remove cuttings and debris. The mud motor, if present in the drill string, may be selectively powered using the circulating drilling fluid.

One common type of drill bit used to drill wellbores is a "fixed cutter" bit, wherein the cutters are secured to the bit body at fixed positions. This type of bit is sometimes referred to as a "drag bit" since the cutters in one respect drag rather than roll in contact with the formation during drilling. The bit body may be formed from a high strength material, such as tungsten carbide, steel, or a composite/matrix material. A plurality of cutters (also referred to as cutter elements, cutting elements, or inserts) is attached at selected locations about the bit body. The cutters may include a substrate or support stud made of a carbide (e.g., tungsten carbide), and an ultra-hard cutting surface layer or "table" made of a polycrystalline diamond material or a polycrystalline boron nitride material deposited onto or otherwise bonded to the substrate. Such cutters are commonly referred to as polycrystalline diamond compact ("PDC") cutters.

In fixed cutter drill bits, PDC cutters are rigidly secured to the bit body, such as by being brazed within corresponding cutter pockets defined on blades that extend from the bit body. Some of the PDC cutters are strategically positioned along the leading edges of the blades to engage the formation during drilling. In use, high forces are exerted on the PDC cutters, particularly in the forward-to-rear direction. Over time, the working surface or cutting edge of each cutter that continuously contacts the formation eventually wears down and/or fails.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1A:
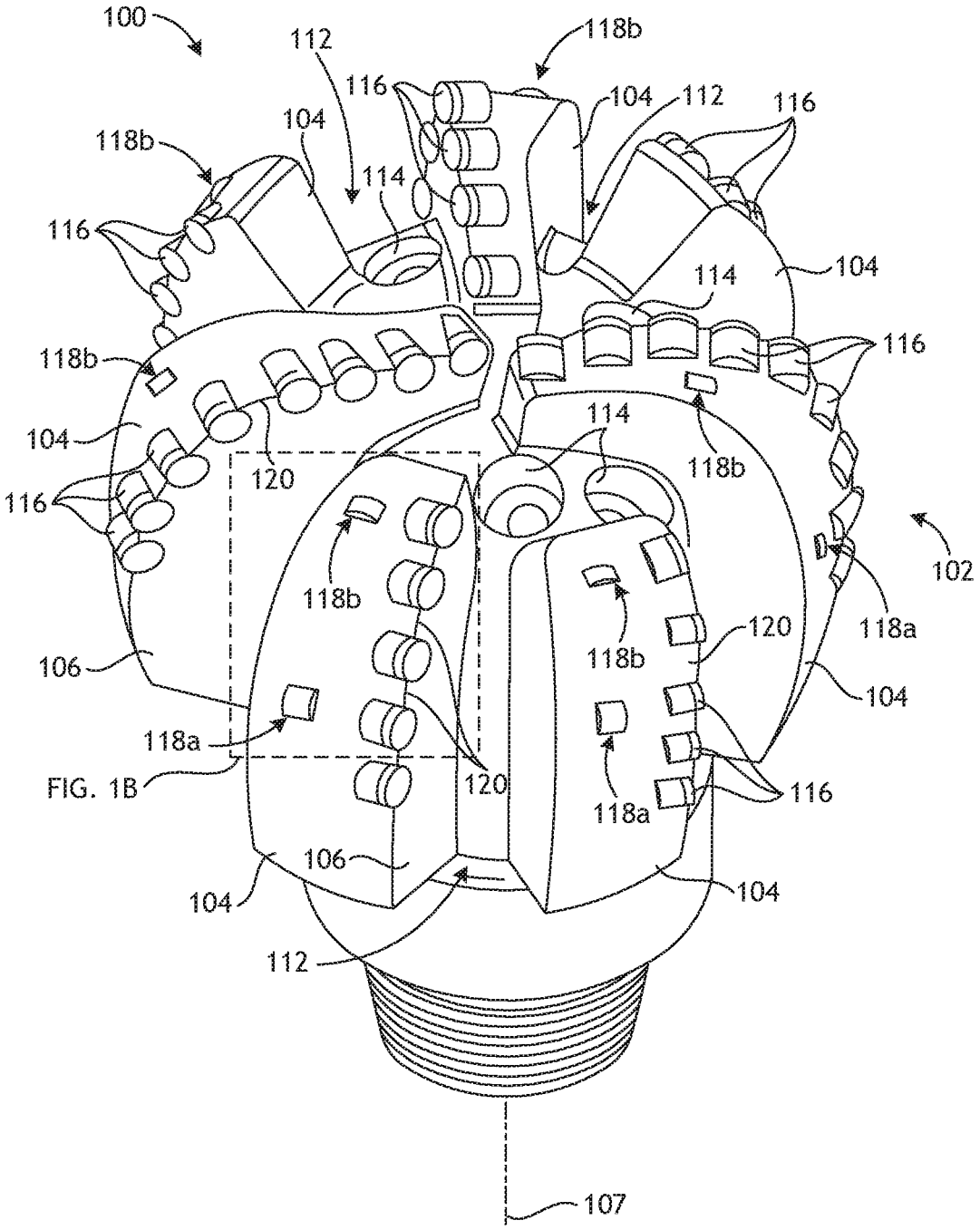
FIG. 1A illustrates an isometric view of a rotary drill bit that may employ the principles of the present disclosure.

The present disclosure relates to earth-penetrating drill bits and, more particularly, to rolling type depth of cut control elements that can be used in drill bits.

The present disclosure includes rolling element assemblies that can be secured within corresponding cavities provided on a drill bit. Each rolling element assembly may include a cylindrical rolling element strategically positioned and secured to the drill bit so that the rolling element is able to engage the formation during drilling. In response to drill bit rotation, and depending on the selected positioning (orientation) of the rolling element with respect to the body of the drill bit, the rolling element may roll against the underlying formation, cut against the formation, or may both roll against and cut the formation. The rolling elements of the presently disclosed rolling element assemblies are retained within corresponding cavities on the bit body using an arcuate retainer received within a retainer cavity defined in the cavity.

Example rolling element assemblies described herein can include a rolling element rotatable about a rotational axis within a cavity defined in a bit body, and a compliant retainer positioned within a retainer slot defined in the bit body. A biasing device may be positioned within a device pocket defined within the bit body to bias the compliant retainer against the outer circumferential surface of the rolling element. The compliant retainer helps to secure the rolling element within the cavity while an arcuate portion of the rolling element protrudes from the cavity and exposes a full axial width of the rolling element. The compliant retainer may be designed so that it will be retained during drilling operations but easily removed for repair operations.

The orientation of each rolling element with respect to the bit body is selected to produce a variety of different functions and/or effects. The selected orientation includes, for example, a selected side rake and/or a selected back rake. In some cases while drilling, the rolling element may be configured as a rolling cutting element that both rolls along the formation (e.g., by virtue of a selected range of side rake) and cuts the formation (e.g., by virtue of the selected back rake and/or side rake). More particularly, the rolling cutting element may be positioned to cut, dig, scrape, or otherwise remove material from the formation using a portion of the rolling element (e.g., a polycrystalline diamond table) that is positioned to engage the formation.

In some example embodiments, the rolling element assemblies described herein can be configured as rolling cutting elements. The rolling cutting elements may be configured to rotate freely about a rotational axis and, as a result, the entire outer edge of the rolling cutting element may be used as a cutting edge. Consequently, rather than only a limited portion of the cutting edge being exposed to the formation during drilling, as in the case of conventional fixed cutters, the entire outer edge of the rolling cutting element will be successively exposed to the formation as it rotates about its rotational axis during drilling. This results in a more uniform cutting edge wear, which may prolong the operational lifespan of the rolling cutting element as compared to conventional cutters.

In other example embodiments, the rolling element assemblies described herein can be configured as rolling depth of cut control (DOCC) elements that roll along the formation as the drill bit rotates. In a rolling DOCC element configuration, the orientation of the rolling element may be selected so that a full axial span of the rolling element bears against the formation. As with rolling cutting elements, rolling DOCC elements may exhibit enhanced wear resilience and allow for additional weight-on-bit without negatively affecting torque-on-bit. This may allow a well operator to minimize damage to the drill bit, thereby reducing trips and non-productive time, and decreasing the aggressiveness of the drill bit without sacrificing its efficiency. The rolling DOCC elements described herein may also reduce friction at the interface between the drill bit and the formation, and thereby allow for a steady depth of cut, which results in better tool face control.

In yet other example embodiments, the rolling element assemblies described herein may operate as a hybrid between a rolling cutting element and a rolling DOCC element. This may be accomplished by orienting the rotational axis of the rolling element on a plane that does not pass through the longitudinal axis of the drill bit nor is the plane oriented perpendicular to a plane that does pass through the longitudinal axis of the drill bit. Those skilled in the art will readily appreciate that the presently disclosed embodiments may improve upon hybrid rock bits, which use a large roller cone element as a depth of cut limiter by sacrificing diamond volume. In contrast, the presently disclosed rolling element assemblies are small in comparison and its enablement will not result in a significant loss of diamond volume on a fixed cutter drag bit.

FIG. 1A is an isometric view of an example drill bit 100 that may employ the principles of the present disclosure. The drill bit 100 is depicted as a fixed cutter drill bit, and the present teachings may be applied to any fixed cutter drill bit category, including polycrystalline diamond compact (PDC) drill bits, drag bits, matrix drill bits, and/or steel body drill bits. While the drill bit 100 is depicted in FIG. 1A as a fixed cutter drill bit, the principles of the present disclosure are equally applicable to other types of drill bits operable to form a wellbore including, but not limited to, roller cone drill bits.

The drill bit 100 has a bit body 102 that includes radially and longitudinally extending blades 104 having leading faces 106. The bit body 102 may be made of steel or a matrix of a harder material, such as tungsten carbide. The bit body 102 rotates about a longitudinal drill bit axis 107 to drill into underlying subterranean formation under an applied weight-on-bit. Corresponding junk slots 112 are defined between circumferentially adjacent blades 104, and a plurality of nozzles or ports 114 can be arranged within the junk slots 112 for ejecting drilling fluid that cools the drill bit 100 and otherwise flushes away cuttings and debris generated while drilling.

The bit body 102 further includes a plurality of cutters 116 secured within a corresponding plurality of cutter pockets sized and shaped to receive the cutters 116. Each cutter 116 in this example comprises a fixed cutter secured within its corresponding cutter pocket via brazing, threading, shrink-fitting, press-fitting, snap rings, or any combination thereof. The fixed cutters 116 are held in the blades 104 and respective cutter pockets at predetermined angular orientations and radial locations to present the fixed cutters 116 with a desired back rake angle against the formation being penetrated. As the drill string is rotated, the fixed cutters 116 are driven through the rock by the combined forces of the weight-on-bit and the torque experienced at the drill bit 100. During drilling, the fixed cutters 116 may experience a variety of forces, such as drag forces, axial forces, reactive moment forces, or the like, due to the interaction with the underlying formation being drilled as the drill bit 100 rotates.

Each fixed cutter 116 may include a generally cylindrical substrate made of an extremely hard material, such as tungsten carbide, and a cutting face secured to the substrate. The cutting face may include one or more layers of an ultra-hard material, such as polycrystalline diamond, polycrystalline cubic boron nitride, impregnated diamond, etc., which generally forms a cutting edge and the working surface for each fixed cutter 116. The working surface is typically flat or planar, but may also exhibit a curved exposed surface that meets the side surface at a cutting edge.

Generally, each fixed cutter 116 may be manufactured using tungsten carbide as the substrate. While a cylindrical tungsten carbide "blank" can be used as the substrate, which is sufficiently long to act as a mounting stud for the cutting face, the substrate may equally comprise an intermediate layer bonded at another interface to another metallic mounting stud. To form the cutting face, the substrate may be placed adjacent a layer of ultra-hard material particles, such as diamond or cubic boron nitride particles, and the combination is subjected to high temperature at a pressure where the ultra-hard material particles are thermodynamically stable. This results in recrystallization and formation of a polycrystalline ultra-hard material layer, such as a polycrystalline diamond or polycrystalline cubic boron nitride layer, directly onto the upper surface of the substrate. When using polycrystalline diamond as the ultra-hard material, the fixed cutter 116 may be referred to as a polycrystalline diamond compact cutter or a "PDC cutter," and drill bits made using such PDC fixed cutters 116 are generally known as PDC bits.

As illustrated, the drill bit 100 may further include a plurality of rolling element assemblies 118, shown as rolling element assemblies 118*a* and 118*b*. The orientation of a rotational axis of each rolling element assembly 118*a,b* with respect to a tangent to an outer surface of the blade 104 may dictate whether the particular rolling element assembly 118*a,b* operates as a rolling DOCC element, a rolling cutting element, or a hybrid of both. As mentioned above, rolling DOCC elements may prove advantageous in allowing for additional weight-on-bit (WOB) to enhance directional drilling applications without over engagement of the fixed cutters 116. Effective DOCC also limits fluctuations in torque and minimizes stick-slip, which can cause damage to the fixed cutters 116.

Figure 1B:
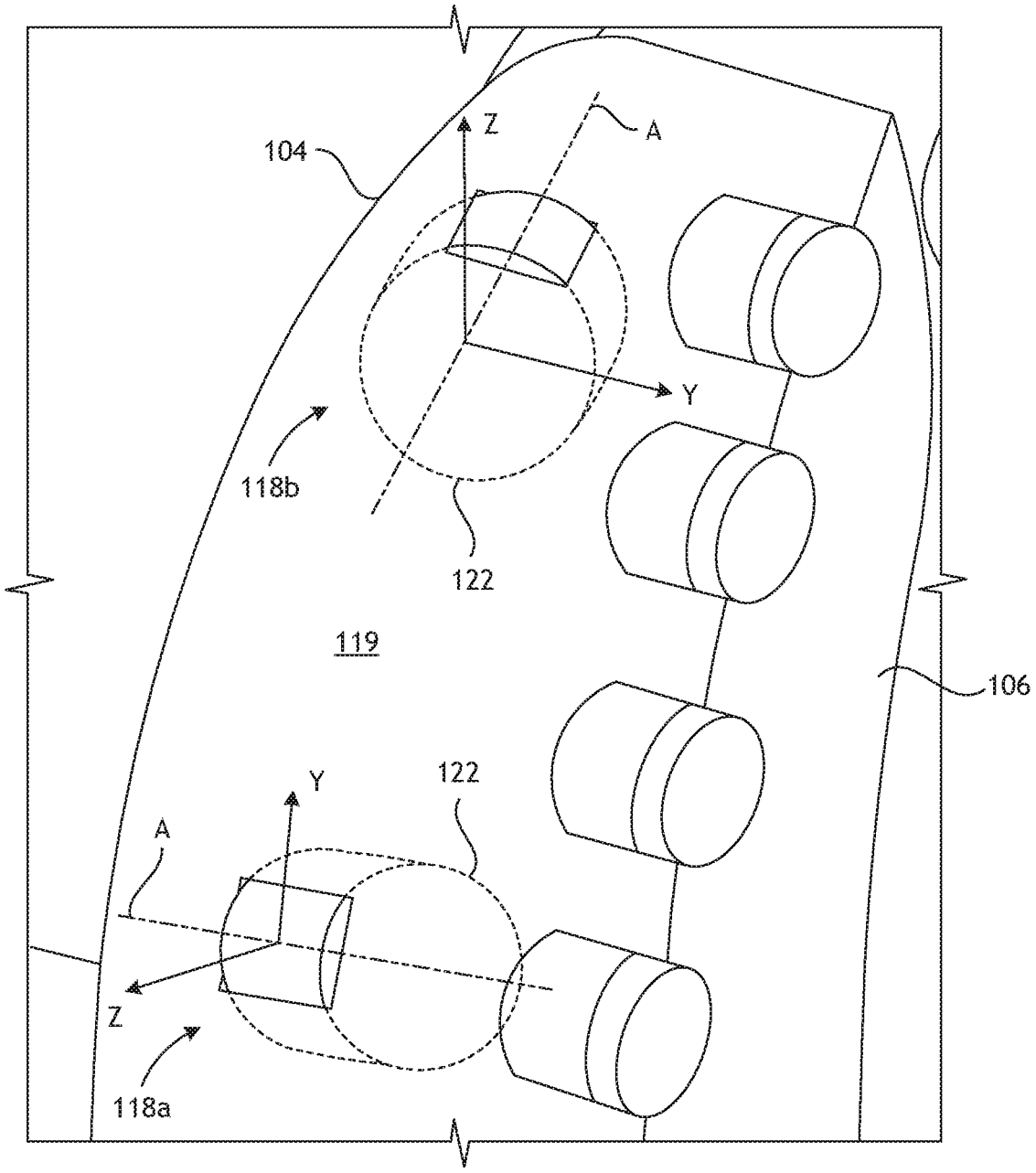
FIG. 1B illustrates an isometric view of a portion of the rotary drill bit enclosed in the indicated box of FIG. 1A.

FIG. 1B is an enlarged portion of the drill bit 100 indicated by the dashed box shown in FIG. 1A. As shown in FIG. 1B, each rolling element assembly 118*a,b* is located in the blade 104 and includes a rolling element 122. Exposed portions of the rolling elements 122 are illustrated in solid linetype, while portions of the rolling elements 122 that are seated within corresponding housings of the rolling element assemblies 118*a,b* are illustrated in dashed linetype. Each rolling element 122 has a rotational axis A, a Z-axis that is perpendicular to the blade profile 138 (FIG. 1D), and a Y-axis that is orthogonal to both the rotational and Z axes.

If, for example, the rotational axis A of the rolling element 122 is substantially parallel to a tangent to the outer surface 119 of the blade profile, the rolling element assembly 118*a,b* may generally operate as a rolling DOCC element. Said differently, if the rotational axis A of the rolling element 122 passes through or lies on a plane that passes through the longitudinal axis 107 (FIG. 1A) of the drill bit 100 (FIG. 1A), then the rolling element assembly 118*a,b* may substantially operate as a rolling DOCC element. If, however, the rotational axis A of the rolling element 122 is substantially perpendicular to the leading face 106 of the blade 104, then the rolling element assembly 118*a,b* may substantially operate as a rolling cutting element. Thus, if the rotational axis A of the rolling element 122 is perpendicular to or lies on a plane that is perpendicular to a plane passing through the longitudinal axis 107 (FIG. 1A) of the drill bit 100 (FIG. 1A), then the rolling element assembly 118*a,b* may substantially operate as a rolling cutting element.

Accordingly, as depicted in FIG. 1B, the first rolling element assembly 118*a* may be positioned to operate as a rolling cutting element and the second rolling element assembly 118*b* may be positioned to operate as a rolling DOCC element. In embodiments where the rotational axis A of the rolling element 122 lies on a plane that does not pass through the longitudinal axis 107 (FIG. 1A) of the drill bit 100 (FIG. 1A) nor is the plane perpendicular to the longitudinal axis 107, the rolling element assembly 118*a,b* may then operate as a hybrid rolling DOCC and cutting element.

Traditional load-bearing type cutting elements for DOCC unfavorably affect torque-on-bit (TOB) by simply dragging, sliding, etc. along the formation, whereas a rolling DOCC element, such as the presently described rolling element assemblies 118*b*, may reduce the amount of torque needed to drill a formation because it rolls to reduce friction losses typical with load bearing DOCC elements. The rolling DOCC elements described herein may also prove advantageous in reducing torque fluctuations and minimizing the occurrence of stick-slip. A rolling DOCC element will also have reduced wear as compared to a traditional bearing element. As will be appreciated, however, one or more of the rolling element assemblies 118*b* can also be used as rolling cutting elements, which may increase cutter effectiveness since it will distribute heat more evenly over the entire cutting edge and minimize the formation of localized wear flats on the rolling cutting element.

Figure 1C:
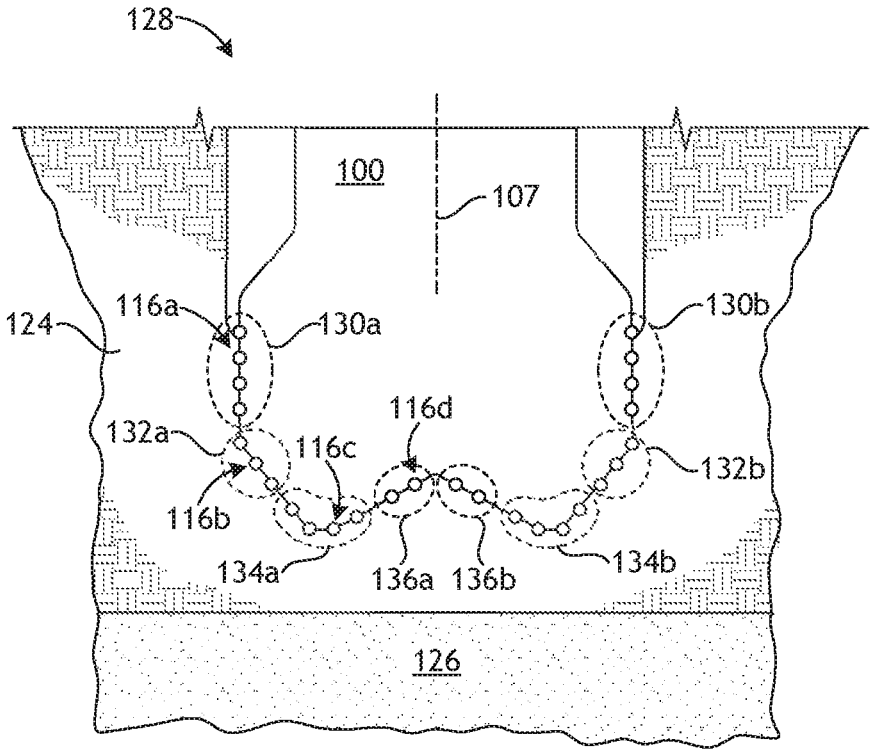
FIG. 1C illustrates a drawing in section and in elevation with portions broken away showing the drill bit of FIG. 1.

FIG. 1C is a drawing in section and in elevation with portions broken away showing the drill bit 100 drilling a wellbore through a first downhole formation 124 and into an underlying second downhole formation 126. The first downhole formation 124 may be described as softer or less hard when compared to the second downhole formation 126. Exterior portions of the drill bit 100 that contact adjacent portions of the first and/or second downhole formations 124, 126 may be described as a bit face, and are projected rotationally onto a radial plane to provide a bit face profile 128. The bit face profile 128 of the drill bit 100 may include various zones or segments and may be substantially symmetric about the longitudinal axis 107 of the drill bit 100 due to the rotational projection of the bit face profile 128, such that the zones or segments on one side of the longitudinal axis 107 may be substantially similar to the zones or segments on the opposite side of the longitudinal axis 107.

For example, the bit face profile 128 may include a first gage zone 130*a* located opposite a second gage zone 130*b*, a first shoulder zone 132*a* located opposite a second shoulder zone 132*b*, a first nose zone 134*a* located opposite a second nose zone 134*b*, and a first cone zone 136*a* located opposite a second cone zone 136*b*. The fixed cutters 116 included in each zone may be referred to as cutting elements of that zone. For example, the fixed cutters 116*a* included in gage zones 130*a,b* may be referred to as gage cutting elements, the fixed cutters 116*b* included in shoulder zones 132*a,b* may be referred to as shoulder cutting elements, the fixed cutters 116*c* included in nose zones 134*a,b* may be referred to as nose cutting elements, and the fixed cutters 116*d* included in cone zones 136*a,b* may be referred to as cone cutting elements.

Cone zones 136*a,b* may be generally concave and may be formed on exterior portions of each blade 104 (FIG. 1A) of the drill bit 100, adjacent to and extending out from the longitudinal axis 107. The nose zones 134*a,b* may be generally convex and may be formed on exterior portions of each blade 104, adjacent to and extending from each cone zone 136. Shoulder zones 132*a,b* may be formed on exterior portions of each blade 104 extending from respective nose zones 134*a,b* and may terminate proximate to a respective gage zone 130*a,b*. The area of the bit face profile 128 may depend on cross-sectional areas associated with zones or segments of the bit face profile 128 rather than on a total number of fixed cutters 116, a total number of blades 104, or cutting areas per fixed cutter 116.

Figure 1D:
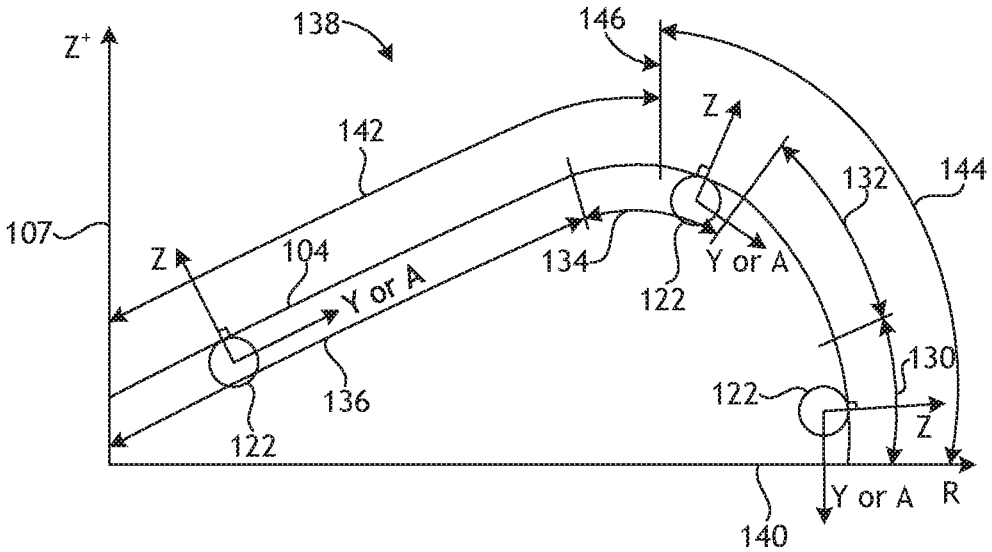
FIG. 1D illustrates a blade profile that represents a cross-sectional view of a blade of the drill bit of FIG. 1.

FIG. 1D illustrates a blade profile 138 that represents a cross-sectional view of one of the blades 104 of the drill bit 100 (FIG. 1A). The blade profile 138 includes the cone zone 136, the nose zone 134, the shoulder zone 132 and the gage zone 130, as described above with respect to FIG. 1C. Each zone 130, 132, 134, 135 may be based on its respective location along the blade 104 with respect to the longitudinal axis 107 and a horizontal reference line 140 that indicates a distance from the longitudinal axis 107 in a plane perpendicular to the longitudinal axis 107. A comparison of FIGS. 1C and 1D shows that the blade profile 138 of FIG. 1D is upside down with respect to the bit face profile 128 of FIG. 1C.

The blade profile 138 includes an inner zone 142 and an outer zone 144. The inner zone 142 extends outward from the longitudinal axis 107 to a nose point 146, and the outer zone 144 extends from the nose point 146 to the end of the blade 104. The nose point 146 may be a location on the blade profile 138 within the nose zone 134 that has maximum elevation as measured by the bit longitudinal axis 107 (vertical axis) from reference line 140 (horizontal axis). A coordinate on the graph in FIG. 1D corresponding to the longitudinal axis 107 may be referred to as an axial coordinate or position. A coordinate corresponding to reference line 140 may be referred to as a radial coordinate or radial position that indicates a distance extending orthogonally from the longitudinal axis 107 in a radial plane passing through longitudinal axis 107. For example, in FIG. 1D, the longitudinal axis 107 may be placed along a Z-axis and the reference line 140 may indicate the distance (R) extending orthogonally from the longitudinal axis 107 to a point on a radial plane that may be defined as the Z-R plane.

Depending on how the rotational axis A (FIG. 1B) of each rolling element assembly 118*a,b* (FIG. 1B) is oriented with respect to the longitudinal axis 107, and, more particularly with respect to the Z-R plane that passes through the longitudinal axis 107, the rolling assemblies 118*a,b* may operate as a rolling DOCC element, a rolling cutting element, or a hybrid thereof. The rolling element assembly 118*a,b* will generally operate as a rolling DOCC element if the rotational axis A of the rolling element 122 lies on the Z-R plane, but will generally operate as a rolling cutting element if the rotational axis A of the rolling element 122 lies on a plane perpendicular to the Z-R plane. The rolling element assembly 118*a,b* may operate as a hybrid rolling DOCC element and a rolling cutting element in embodiments where the rotational axis A of the rolling element 122 lies on a plane offset from the Z-R plane, but not perpendicular thereto.

Depending on how they are oriented with respect to the longitudinal axis 107, each rolling element assembly 118*a,b* (FIG. 1B) may exhibit side rake or back rake during operation. Side rake can be defined as the angle between the rotational axis A (FIG. 1B) of the rolling element 122 and the Z-R plane that extends through the longitudinal axis 107. When the rotational axis A is parallel to the Z-R plane, the side rake is substantially 0°, such as in the case of the second rolling element assembly 118*b* of FIG. 1B. When the rotational axis A is perpendicular to the Z-R plane, however, the side rake is substantially 90°, such as in the case of the first rolling element assembly 118*a* of FIG. 1B. When viewed along the Z-axis from the positive Z-direction (viewing toward the negative Z-direction), a negative side rake results from counterclockwise rotation of the rolling element 122, and a positive side rake results from clockwise rotation of the rolling element 122. Said differently, when viewing from the top of the blade profile 128, a negative side rake results from counterclockwise rotation of the rolling element 122, and a positive side rake results from clockwise rotation of the rolling element 122 about the Z-axis.

Back rake can be defined as the angle subtended between the Z-axis of a given rolling element 122 and the Z-R plane. More particularly, as the Z-axis of a given rolling element 122 rotates offset backward or forward from the Z-R plane, the amount of offset rotation is equivalent to the measured back rake. If, however, the Z-axis of a given rolling element 122 lies on the Z-R plane, the back rake for that rolling element 122 will be 0°.

In some embodiments, one or more of the rolling element assemblies 118*a,b* may exhibit a side rake that ranges between 0° and 45° (or 0° and −45°), or alternatively a side rake that ranges between 45° and 90° (or −45° and −90°). In other embodiments, one or more of the rolling element assemblies 118*a,b* may exhibit a back rake that ranges between 0° and 45° (or 0° and −45°). The selected side rake will affect the amount of rolling versus the amount of sliding that a rolling element 122 included with the rolling element assembly 118*a,b* will undergo, whereas the selected back rake will affect how a cutting edge of the rolling element 122 engages the formation (e.g., the first and second formations 124, 126 of FIG. 1C) to cut, scrape, gouge, or otherwise remove material.

Referring again to FIG. 1A, the second rolling element assemblies 118*b* may be placed in the cone region of the drill bit 100 and otherwise positioned so that rolling element assemblies 118*b* track in the path of the adjacent fixed cutters 116; e.g., they are placed in a secondary row behind the primary row of fixed cutters 116 on the blade 104. However, since the second rolling element assemblies 118*b* are able to roll, they can be placed in positions other than the cone without affecting TOB.

Strategic placement of the first and second rolling element assemblies 118*a,b* may further allow them to be used as either primary and/or secondary rolling cutting elements as well as rolling DOCC elements, without departing from the scope of the disclosure. For instance, in some embodiments, one or more of the rolling element assemblies 118*a,b* may be located in a kerf forming region 120 located between adjacent fixed cutters 116. During operation, the kerf forming region 120 results in the formation of kerfs on the underlying formation being drilled. One or more of the rolling element assemblies 118*a,b* may be located on the bit body 102 such that they will engage and otherwise extend across one or multiple formed kerfs during drilling operations. In such an embodiment, the rolling element assemblies 118*a,b* may also function as prefracture elements that roll on top of or otherwise crush the kerf(s) formed on the underlying formation between adjacent fixed cutters 116. In other cases, one or more of the rolling element assemblies 118*a,b* may be positioned on the bit body 102 such that they will proceed between adjacent formed kerfs during drilling operations. In yet other embodiments, one or more of the rolling element assemblies 118*a,b* may be located at or adjacent the apex of the drill bit 100 (i.e., at or near the longitudinal axis 107). In such embodiments, the drill bit 100 may fracture the underlying formation more efficiently.

In some embodiments, as illustrated, the rolling element assemblies 118*a,b* may each be positioned on a respective blade 104 such that the rolling element assemblies 118*a,b* extend orthogonally from the outer surface 119 (FIG. 1B) of the respective blade 104. In other embodiments, however, one or more of the rolling element assemblies 118*a,b* may be positioned at a predetermined angular orientation (three degrees of freedom) offset from normal to the profile of the outer surface 119 of the respective blade 104. As a result, the rolling element assemblies 118*a,b* may exhibit an altered or desired back rake angle, side rake angle, or a combination of both. As will be appreciated, the desired back rake and side rake angles may be adjusted and otherwise optimized with respect to the primary fixed cutters 116 and/or the surface 119 (FIG. 1B) of the blade 104 on which the rolling element assemblies 118*a,b* are disposed.

Figure 2:
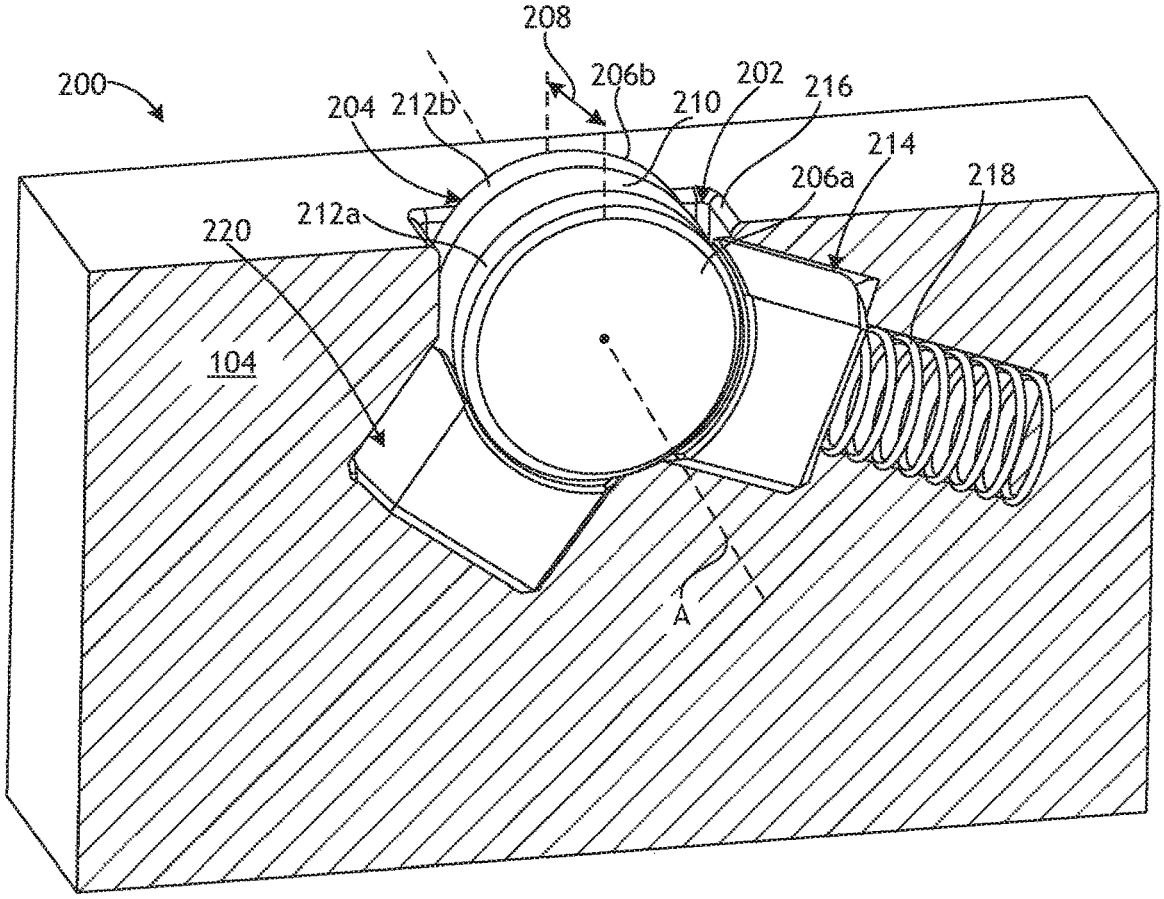
FIG. 2 is a partial cross-sectional, isometric view of one example of a rolling element assembly.

FIG. 2 is a partial cross-sectional, isometric view of one example of a rolling element assembly 200, according to one or more embodiments. The rolling element assembly 200 may be used, for example, with the drill bit 100 of FIGS. 1A-1B, in which case the rolling element assembly 200 may be a substitution for either of the rolling element assemblies 118*a,b* or a specific example embodiment of the rolling element assemblies 118*a,b*.

As illustrated, the rolling element assembly 200 may be positioned within a cavity 202 defined in a blade 104 of the drill bit 100 (FIG. 1A). Only a portion of the blade 104 is represented in FIG. 2 and depicted in the general shape of a rectangular cube in cross-section. In embodiments where the drill bit 100 is made of a matrix material, the cavity 202 may be formed by selectively placing displacement materials (i.e., consolidated sand or graphite) at the location where the cavity 202 is to be formed. In embodiments where the drill bit 100 comprises a steel body drill bit, conventional machining techniques may be employed to machine the cavity 202 to desired dimensions at the desired location. Moreover, while the cavity 202 is shown as being defined in the blade 104, it will be appreciated that the principles of the present disclosure are equally applicable to the cavity 202 being defined and otherwise provided at other locations of the drill bit 100, without departing from the scope of the disclosure.

The rolling element assembly 200 includes a rolling element 204 that comprises a generally cylindrical or disk-shaped body having a first axial end 206*a* and a second axial end 206*b* opposite the first axial end 206*a*. The distance between the first and second axial ends 206*a,b* is referred to herein as the axial width 208 of the rolling element 204.

The rolling element 204 includes a substrate 210 and opposing diamond tables 212*a* and 212*b* arranged at the first and second axial ends 206*a,b*, respectively, and otherwise coupled to opposing axial ends of the substrate 210. The substrate 210 may be formed of a variety of hard or ultra-hard materials including, but not limited to, steel, steel alloys, tungsten carbide, cemented carbide, any derivatives thereof, and any combinations thereof. Suitable cemented carbides may contain varying proportions of titanium carbide (TiC), tantalum carbide (TaC), and niobium carbide (NbC). Additionally, various binding metals may be included in the substrate 210, such as cobalt, nickel, iron, metal alloys, or mixtures thereof. In the substrate 210, the metal carbide grains are supported within a metallic binder, such as cobalt. In other cases, the substrate 210 may be formed of a sintered tungsten carbide composite structure or a diamond ultra-hard material, such as polycrystalline diamond (PCD) or thermally stable polycrystalline diamond (TSP).

The diamond tables 212*a,b* may be made of a variety of ultra-hard materials including, but not limited to, polycrystalline diamond (PCD), thermally stable polycrystalline diamond (TSP), cubic boron nitride, impregnated diamond, nanocrystalline diamond, ultra-nanocrystalline diamond, and zirconia. Such materials are extremely wear-resistant and are suitable for use as bearing surfaces, as herein described.

The rolling element 204 may comprise and otherwise include one or more cylindrical bearing portions. More particularly, in this example, the entire rolling element 204 is cylindrical and made of hard, wear-resistant materials, and thus any portion of the rolling element 204 may be considered as a cylindrical bearing portion to the extent it slidingly engages a bearing surface of the cavity 202 or another component of the rolling element assembly 200 while rolling, such as would be expected during drilling operations. In some embodiments, for instance, one or both of the diamond tables 212*a,b* may be considered cylindrical bearing portions for the rolling element 204 and contact adjacent sidewalls of the cavity 202 during operation. In other embodiments, one or both of the diamond tables 212*a,b* may be omitted from the rolling element 204 and the substrate 210 may alternatively be considered as a cylindrical bearing portion. In yet other embodiments, the entire cylindrical or disk-shaped rolling element 204 may be considered as a cylindrical bearing portion and may be made of any of the hard or ultra-hard materials mentioned herein, without departing from the scope of the disclosure.

It should be noted that the features of the rolling element 204 are shown for illustrative purposes only and may or may not be drawn to scale. Consequently, the rolling element 204 as depicted should not be considered as limiting the scope of the present disclosure. For example, the thickness or axial extent (length) of the diamond tables 212*a,b* may or may not be the same. In at least one embodiment, for instance, one of the diamond tables 212*a,b* may be thicker than the other. Moreover, in some embodiments, one of the diamond tables 212*a,b* may be omitted from the rolling element 204 altogether. In yet other embodiments, the substrate 210 may be omitted and the rolling element 204 may instead be made entirely of the material of the diamond tables 212*a,b*.

The rolling element assembly 200 also includes a compliant retainer 214 used to help secure or retain the rolling element 204 in the cavity 202 during use. The cavity 202 provides and otherwise defines an opening 216 large enough to receive the rolling element 204; i.e., the length of the opening 216 is larger than the diameter of the rolling element 204. When seated within the cavity 202, an arcuate portion of the rolling element 204 extends out of cavity 202 at the opening 216, which exposes the full axial width 208 of the rolling element 204. As will be described in greater detail below, a biasing device 218 may be included to act on and urge the compliant retainer 214 against the outer circumference of the rolling element 204 and thereby retain the rolling element 204 within the cavity 202 during operation. This is accomplished as portions of the cavity 202 and the compliant retainer 214 jointly encircle more than 180° of the circumference of the rolling element 204, but less than 360°, so that the full axial width 208 of the rolling element 204 remains exposed for external contact with a formation during operation.

The compliant retainer 214 may exhibit a variety of cross-sectional shapes. In the illustrated embodiment, for example, the compliant retainer 214 is depicted as exhibiting a generally rectangular cross-section with two rounded (arced) sides. In other embodiments, however, the cross-section of the compliant retainer 214 may be circular, oval, ovoid, or any other polygonal shape, without departing from the scope of the disclosure.

In at least one embodiment, as illustrated, the rolling element assembly 200 may further include a bearing element 220 also positioned within the cavity 202 and engageable with the outer circumference of the rolling element 204. Similar to the compliant retainer 214, the bearing element 220 may exhibit a variety of cross-sectional shapes including, but not limited to, polygonal (e.g., rectangular, square, etc.), circular, oval, ovoid, or any combination thereof. In other embodiments, however, the bearing element 220 may be omitted, without departing from the scope of the disclosure. In such embodiments, the rolling element 204 may instead engage an inner arcuate surface or wall of the cavity 202.

During drilling operations, the rolling element 204 is able to rotate within the cavity 202 about a rotational axis A of the rolling element 204. As the rolling element 204 rotates about the rotational axis A, the compliant retainer 214 maintains the rolling element 204 within the cavity while allowing an arcuate portion to extend out of the cavity 202 through the opening 216 to engage (i.e., cut, roll against, or both) the underlying formation. This allows the full axial width 208 of the rolling element 204 across the entire outer circumferential surface to be progressively used as the rolling element 204 rotates during use.

Figure 3:
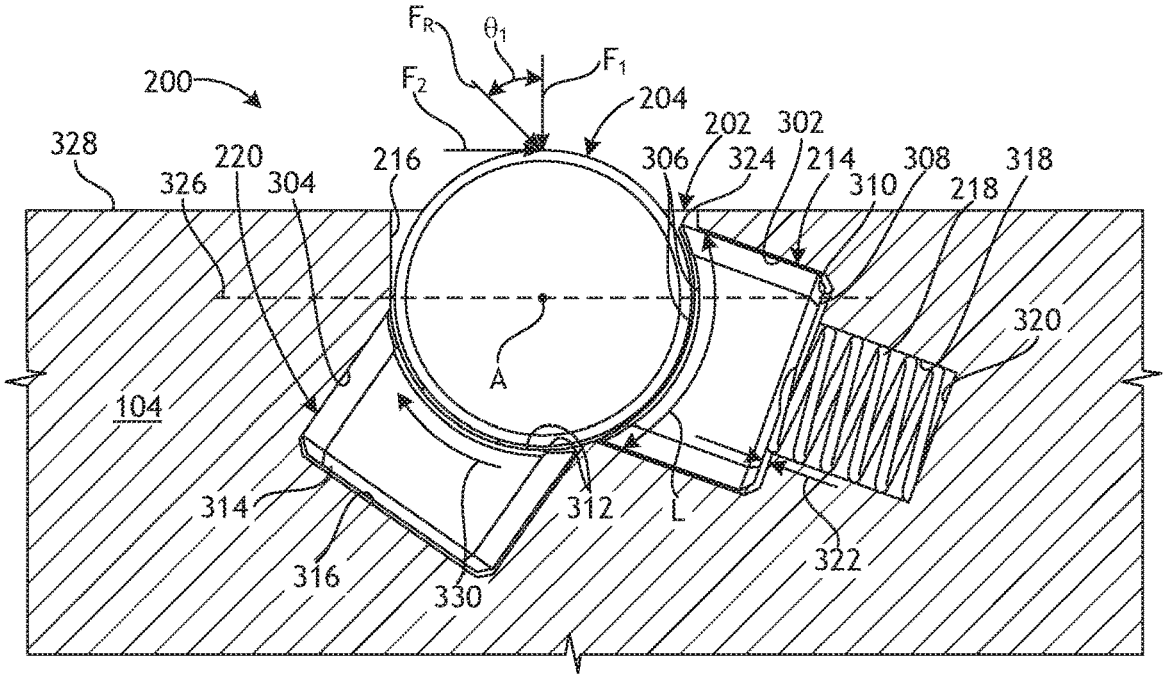
FIG. 3 is a partial cross-sectional side view of the rolling element assembly of FIG. 2.

FIG. 3 is a partial cross-sectional side view of the rolling element assembly 200 as installed within the cavity 202 defined in the blade 104. As illustrated, the blade 104 (e.g., the bit body 102 of FIG. 1A) may provide or otherwise define a retainer slot 302 extending from and communicating with the volume of the cavity 202 and configured to receive and accommodate the compliant retainer 214. Moreover, in embodiments where the bearing element 220 is included in the rolling element assembly 200, the blade 104 (e.g., the bit body 102 of FIG. 1A) may further provide or otherwise define a bearing slot 304 extending from and communicating with the volume of the cavity 202 and configured to receive and accommodate the bearing element 220. The retainer and bearing slots 302, 304 may exhibit a shape generally configured to receive the cross-sectional shape of the compliant retainer 214 and the bearing element 220, respectively.

The compliant retainer 214 provides an inner arcuate surface 306 and a back surface 308 opposite the inner arcuate surface 306. With the compliant retainer 214 received within the retainer slot 302, the back surface 308 will be disposed against or otherwise adjacent a bottom 310 of the retainer slot 302 and the inner arcuate surface 306 will be disposed against or otherwise adjacent the outer circumferential surface of the rolling element 204. Similarly, the bearing element 220 provides an inner arcuate surface 312 and a back surface 314 opposite the inner arcuate surface 306. With the bearing element 220 received within the bearing slot 304, the back surface 314 will be disposed against or otherwise adjacent a bottom 316 of the bearing slot 304 and the inner arcuate surface 312 will be disposed against or otherwise adjacent the outer circumferential surface of the rolling element 204. The curvature of the inner arcuate surfaces 306, 312 and the interposing inner wall of the cavity 202 (if any) enables the rolling element 204 to bear against a continuously (uniformly) curved surface at all angular locations within the cavity 202 during operation.

The compliant retainer 214 and the bearing element 220 (if used) can be made of any of the hard or ultra-hard materials mentioned above for the substrate 212 and the diamond tables 214*a,b*. More specifically, the compliant retainer 214 and/or the bearing element 220 may be of materials such as, but not limited to, steel, a steel alloy, tungsten carbide, a sintered tungsten carbide composite structure, cemented carbide, polycrystalline diamond (PCD), thermally stable polycrystalline diamond (TSP), cubic boron nitride, impregnated diamond, nanocrystalline diamond, ultra-nanocrystalline diamond, zirconia, any derivatives thereof, and any combinations thereof. Alternatively, or in addition thereto, the compliant retainer 214 and/or the bearing element 220 may be made of an engineering metal, a coated material (i.e., using processes such as chemical vapor deposition, plasma vapor deposition, etc.), or other hard or abrasion-resistant materials.

The biasing device 218 may be positioned within a device pocket 318 defined within the blade 104 (e.g., the bit body 102 of FIG. 1A) and extending from and otherwise communicating with the retainer slot 302. In some embodiments, as illustrated, the biasing device 218 comprises a helical compression spring. In other embodiments, however, the biasing device 318 may comprise any other device or means capable of biasing the compliant retainer 214 into engagement with the outer circumference of the rolling element 204. For example, the biasing device 318 may alternatively comprise a series of Belleville washers, an air shock, a hydraulic shock, an engineered polymer, a plastic, an elastic material, or any combination of the foregoing.

In the illustrated embodiment, the biasing device 218 is positioned between and otherwise engageable with the back surface 308 of the compliant retainer 214 and a bottom 320 of the device pocket 318. When the rolling element assembly 200 is properly assembled, the biasing device 218 acts on and urges the compliant retainer 214 against the outer circumference of the rolling element 204, which moves the compliant retainer 214 off the bottom 310 of the retainer slot 302. As a result, a gap 322 can form between the back surface 308 of the compliant retainer 214 and the bottom 310. Formation of the gap 322 allows the rolling element 204 to be properly retained within the cavity 202 for operation and also facilitates an amount of give that the rolling element assembly 200 may assume during operation, which may prove advantageous in extending the service life of the rolling element 204.

The rolling element assembly 200 may be assembled by first inserting the biasing device 218 into the device pocket 318 and subsequently inserting the compliant retainer 214 into the retainer slot 302, and thereby engaging the back surface 308 of the compliant retainer 214 against the biasing device 218. As biased by the biasing device 218, the compliant retainer 214 extends partially into the volume of the cavity 202 and the gap 322 will be at its largest. If included in the rolling element assembly 200, the bearing element 220 may also be inserted into the bearing slot 304. The rolling element 204 may then be inserted into the cavity 202 via the opening 216. As the rolling element 204 extends into the cavity 202, it engages an upper extent 324 of the compliant retainer 214, which forms part of the inner arcuate surface 306. Engaging the upper extent 324 pushes (urges) the compliant retainer 214 deeper into the retainer slot 302 and thereby decreases the magnitude of the gap 322 and simultaneously compresses the biasing device 218, which builds spring (biasing) force. Once the diameter of the rolling element 204 traverses (surpasses) the upper extent 324, the spring force is able to at least partially release and the biasing device 218 urges the compliant element 214 against the rolling element 204 and the inner arcuate surface 306 is brought into engagement with the outer circumference of the rolling element 204.

As biased against the outer circumference of the rolling element 204, the compliant element 214 serves to retain the rolling element 204 within the cavity 202. More specifically, when the rolling element 204 is assembled in the cavity 202, the rolling element 204 exhibits a centerline 326 that is generally parallel with (or tangent to) the opening 216 and perpendicular to the rotational axis A. Since the upper extent 324 of the compliant retainer 214 extends above the centerline 326, more than 180° (but less than 360°) of the circumference of the rolling element 204 will be engaged with and otherwise encircled by the compliant retainer 214, portions of the inner arcuate walls of the cavity 202, and/or the bearing element 220 (if used). Moreover, the cavity 202 is sized such that the rolling element 204 bottoms out with an arcuate portion extending out of the opening 216 so that the full axial width 208 (FIG. 2) of the rolling element 204 remains exposed for external contact with a formation during operation.

In some applications, the rolling element assembly 200 may be arranged on the blade 104 such that the rolling element 204 will rotate about the rotational axis A in a first direction 330 during operation. As the rolling element 204 engages an underlying subterranean formation and rotates about the rotational axis A, a weight on bit (WOB) force $F_1$ and a friction force $F_2$ will act on the rolling element 204. The WOB force $F_1$ is the weight force applied to the rolling element 204 in the direction of advancement of the drill bit 100 (FIGS. 1A-1B). The friction force $F_2$ is a drag force assumed by the rolling element 204 and applied in the direction opposite rotation of the drill bit 100. Based on the respective magnitudes of the WOB force $F_1$ and the friction force $F_2$, a resultant force $F_R$ will be assumed by the rolling element 204. The magnitude of the resultant force $F_R$ may be determined as follows:

$$F_R^2 F_1^2 + F_2^2 \qquad \text{Equation (1)}$$

and the resultant force $F_R$ vector will be directed at an angle θ offset from the WOB force $F_1$. The angle θ may be determined as follows: $F_R$ $$\theta = \arctan\frac{F_R}{F_1} \qquad \text{Equation (2)}$$

If the direction of the resultant force $F_R$ vector intersects the compliant retainer 214 as positioned within the retainer slot 302, then the compliant retainer 214 may not only be used to help retain the rolling element 204 in the cavity 202, but may also prove useful as a bearing element that assumes at least a portion of the resultant force $F_R$ of the rolling element 204 during drilling operations. In such embodiments, the biasing device 218 may prove advantageous in assuming shock or impact loads during operation, which would abruptly decrease the magnitude of the gap 322. If, however, the direction of the resultant force $F_R$ vector does not intersect the compliant retainer 214, then the compliant retainer 214 will primarily serve as a structure that helps retain the rolling element 204 in the cavity 202.

In the illustrated embodiment, an arc length L of the compliant retainer 214 is long enough such that the resultant force $F_R$ vector will intersect the compliant retainer 214, which allows the compliant retainer 214 to simultaneously operate as a retaining structure and a bearing element. In other embodiments, however, and depending on known or predicted drilling parameters, the arc length L of the compliant retainer 214 may be increased or decreased to allow the compliant retainer 214 to operate solely as a retainer. Accordingly, the compliant retainer 214 not only helps secure the rolling element 204 in the cavity 202, but can also serve as a bearing surface that supports and guides the rolling element 204.

Alternatively, the friction force $F_2$ may be applied on the rolling element 204 in a direction opposite to that which is shown in FIG. 3. In such embodiments, the resultant force $F_R$ would be instead directed generally at the bearing element 220, which would assume most (if not all) of the impact loading during operation. The compliant retainer 214 would then serve the primary purpose of retaining the rolling element 204 within the cavity 202. The biasing device 218 may be configured and otherwise designed to provide sufficient biasing force to maintain constant contact between the compliant retainer 214 and the rolling element 204.

Given the design of the rolling element assembly 200, the force exerted on the compliant retainer 214 or the bearing element 220 during operation will be primarily compressive in nature. Having the compliant retainer 214 and the bearing element 220 made of a hard or ultra-hard material may help reduce the amount of friction and wear between the rolling element 204 and the inner arcuate surfaces 306, 312 as the rolling element 204 bears and slides against the inner arcuate surfaces 306, 312. Consequently, the hard or ultra-hard materials of the compliant retainer 214 and the bearing element 220 may reduce or eliminate the need for lubrication between the rolling element 204 and the inner arcuate surfaces 306, 312 of the compliant retainer 214 and the bearing element 220, respectively. In at least one embodiment, however, one or both of the inner arcuate surfaces 306, 312 may be polished so as to reduce friction between the opposing surfaces. The inner arcuate surfaces 306, 312 may be polished, for example, to a surface finish of about 40 micro-inches or better.

It should be noted that, although the rolling element assembly 200 has been described as retaining one rolling element 204, embodiments of the disclosure are not limited thereto and the rolling element assembly 200 (or any of the rolling element assemblies described herein) may include and otherwise use two or more rolling elements 204, without departing from the scope of the disclosure. In such embodiments, the multiple rolling elements 204 may be retained within the cavity 202 using the compliant retainer 214 or each rolling element 204 may be supported by individual compliant retainers 214.

Figure 4:
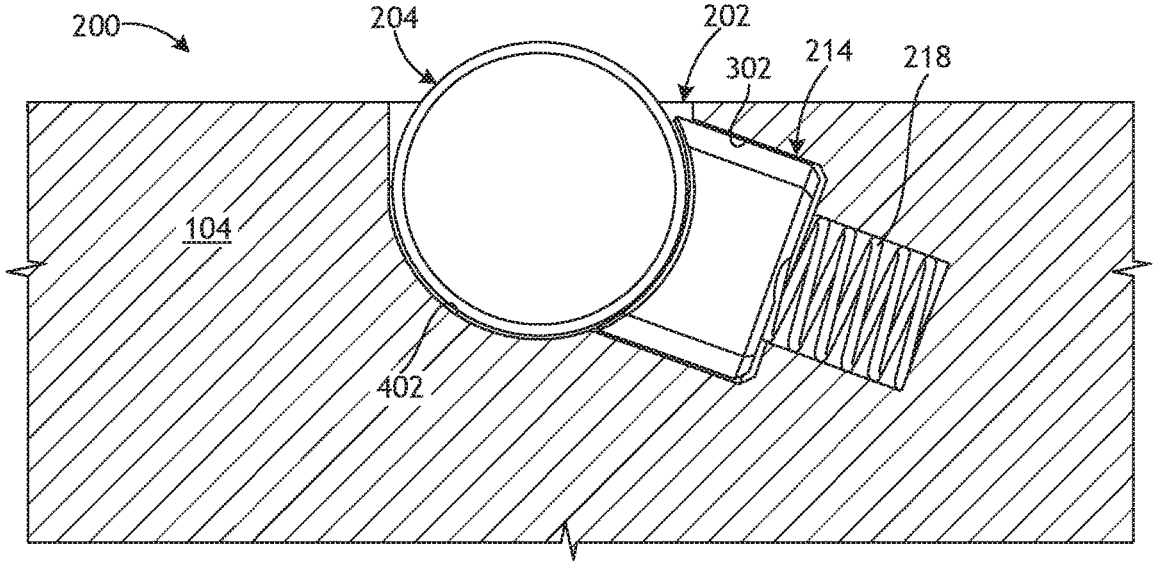
FIG. 4 is a partial cross-sectional side view of another embodiment of the rolling element assembly of FIG. 2.

FIG. 4 is a partial cross-sectional side view of another embodiment of the rolling element assembly 200 as installed within the cavity 202 defined in the blade 104. Unlike the embodiment of FIG. 3, the bearing element 220 (FIG. 3) is omitted from the embodiment of FIG. 4. As illustrated, the compliant retainer 214 is arranged within the retainer slot 302 and maintains the rolling element 204 within the cavity 202. The biasing device 218 acts on and urges the compliant retainer 214 against the outer circumference of the rolling element 204. Assembly of the embodiment of FIG. 4 is similar to the assembly of the embodiment of FIG. 3 and, therefore, will not be provided again. During operation, the resultant force $F_R$ (FIG. 3) may be directed toward and assumed by an inner arcuate surface 402 of the cavity 202, thereby allowing the compliant retainer 214 to serve the primary purpose of retaining the rolling element 204 within the cavity 202.

Figure 5:
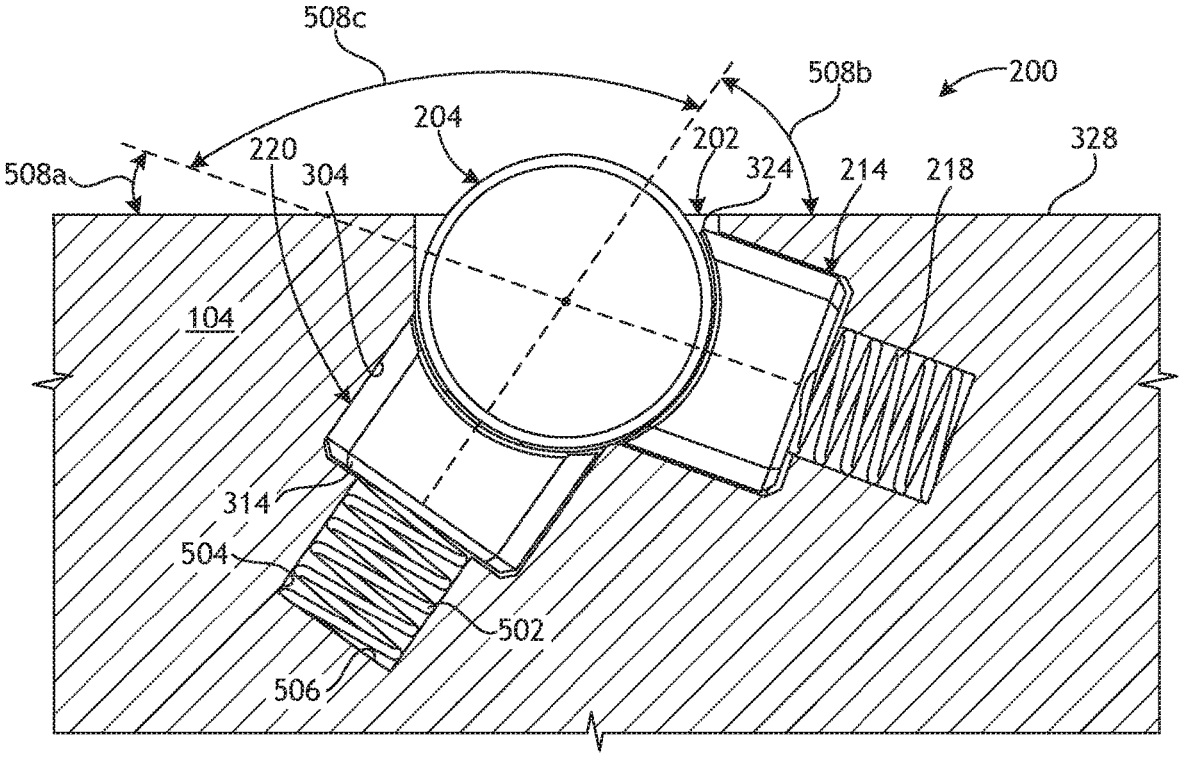
FIG. 5 is a partial cross-sectional side view of another embodiment of the rolling element assembly of FIG. 2.

FIG. 5 is a partial cross-sectional side view of another embodiment of the rolling element assembly 200 as installed within the cavity 202 defined in the blade 104. In the illustrated embodiment, a second biasing device 502 may be positioned within a second device pocket 504 defined within the blade 104 (e.g., the bit body 102 of FIG. 1A) and extending from and otherwise communicating with the bearing slot 304 that receives the bearing element 220. Similar to the biasing device 218, in some embodiments the second biasing device 502 may comprise a helical compression spring, as illustrated, but may alternatively comprise any other device or means capable of biasing the bearing element 220 into engagement with the outer circumference of the rolling element 204. For example, the biasing device 318 may alternatively comprise a series of Belleville washers, an air shock, a hydraulic shock, an engineered polymer, a plastic, an elastic material, or any combination of the foregoing.

In the illustrated embodiment, the second biasing device 502 is positioned between and otherwise engageable with the back surface 314 of the bearing element 220 and a bottom 506 of the second device pocket 504. When the rolling element assembly 200 is assembled within the cavity 202, the second biasing device 502 acts on and urges the bearing element 220 against the outer circumference of the rolling element 204. Similar to the operation of the biasing device 218, the second biasing device 502 may also prove advantageous in assuming shock or impact loading from the rolling element 204 during operation, and thereby help extend the operational life of the rolling element assembly 200.

In some embodiments, the retainer slot 302 may be defined in the blade 104 at a first angle 508*a* relative to the outer surface 328 of the blade 104, and the bearing slot 304 may be defined in the blade 104 at a second angle 508*b* relative to the outer surface 328 of the blade 104 such that the retainer and bearing slots 302, 304 may be angularly offset from each other by a third angle 508*c*. The angles 508*a,b* may be optimized depending on the type of drill bit being used and the projected rate of penetration. For example, the first angle 508*a* may dictate what geometry is suitable for the compliant retainer 204 to properly retain the rolling element 204 within the cavity 202. More specifically, the first angle 508*a* may be optimized such that the upper extent 324 extends above the centerline 326 (FIG. 3) of the rolling element 204 such that more than 180° (but less than 360°) of the circumference of the rolling element 204 will be encircled at any given moment to lock the rolling element 204 within the cavity 202. Moreover, the second angle 508*b* may be optimized and otherwise configured such that the bearing element 220 lies substantially perpendicular to a projected load direction (e.g., the resultant force $F_R$ of FIG. 3) expected during drilling operations to enable the bearing element 220 to assume most (if not all) of the loading.

Figure 6:
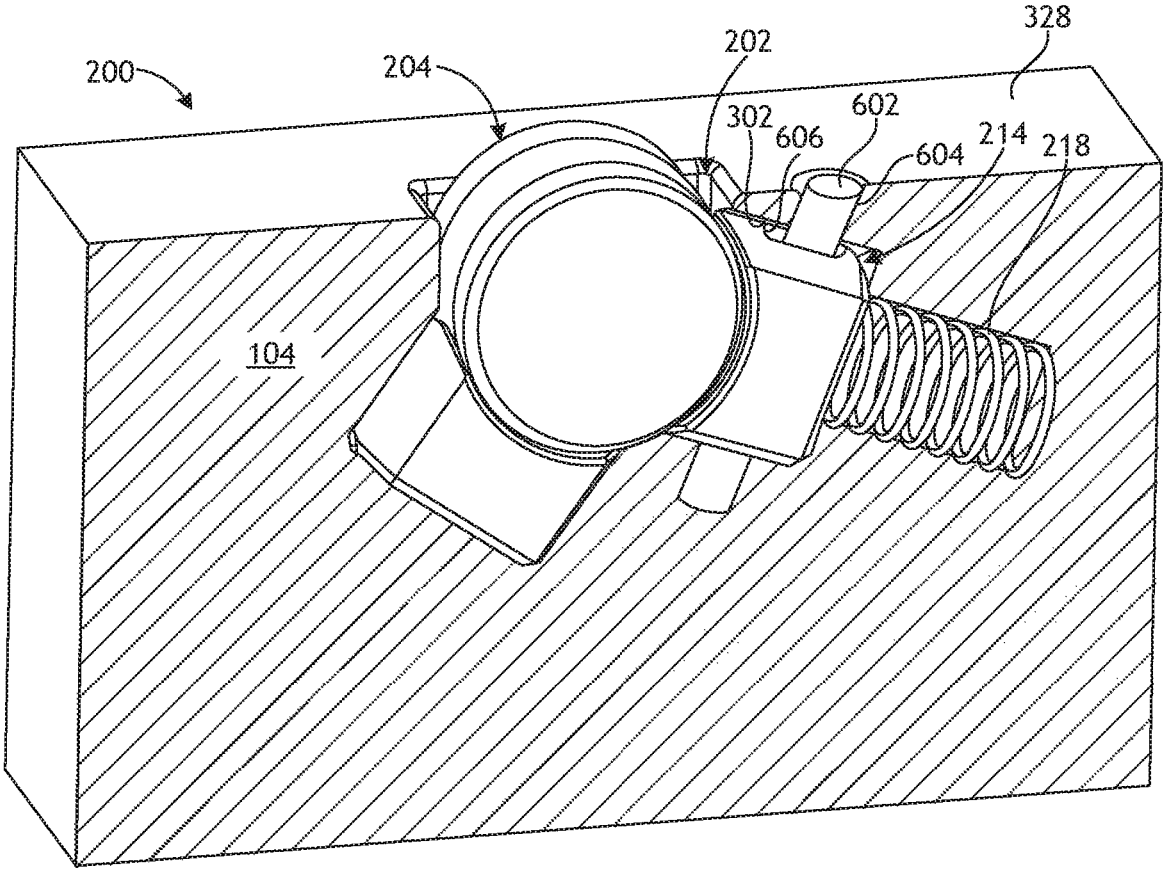
FIG. 6 is a partial cross-sectional, isometric view of another example embodiment of the rolling element assembly of FIG. 2.

FIG. 6 is a partial cross-sectional, isometric view of another example of the rolling element assembly 200, according to one or more embodiments. In the illustrated embodiment, a locking pin 602 may be included in the rolling element assembly 200 and used to secure the rolling element 204 within the cavity 202. More particularly, the locking pin 602 may be insertable into (accommodated within) a body aperture 604 defined in the blade 104 and extending from the outer surface 328 of the blade 104. The body aperture 604 extends to and penetrates the retainer slot 302. In some embodiments, as illustrated, the body aperture 604 may extend past (through) the retainer slot 302 and deeper into the blade 104, but may alternatively only penetrate the retainer slot 302, without departing from the scope of the disclosure.

The compliant retainer 214 may provide and otherwise define a retainer aperture 606 alignable with the body aperture 604 when the compliant retainer 214 is arranged in the retainer slot 302. The locking pin 602 is configured to be extended into the body aperture 604 and simultaneously into the aligned retainer aperture 606 to lock the compliant retainer 214 in place within the retainer slot 302. This may prove advantageous in helping to secure the rolling element 204 within the cavity 202 since the compliant retainer 214 would be unable to move to a position in the retainer slot 302 where the rolling element 204 would be able to bypass the upper extent 324 for extraction from the cavity 202.

In some embodiments, the locking pin 602 may be threaded into one or both of the blade and retainer apertures 604, 606. In other embodiments, the locking pin 602 may simply be extended into the blade and retainer apertures 604, 606. The locking pin 602 may exhibit a variety of cross-sectional shapes. In the illustrated embodiment, for example, the locking pin 602 is depicted as exhibiting a generally circular cross-section. In other embodiments, however, the cross-section of the compliant retainer 214 may be oval, ovoid, or polygonal, without departing from the scope of the disclosure.

In some embodiments, the retainer aperture 606 may be sized to allow the compliant retainer 214 a small amount of travel within the retainer slot 302. More specifically, as illustrated, the retainer aperture 606 may be defined as an elongated oval that allows the compliant retainer 214 to translate a small distance within the retainer slot 302 as constrained by the geometry of the elongated oval. This may prove advantageous in allowing the compliant retainer 214 to exhibit an amount of give as biased against the biasing device 218 during operation. As a result, shock or impact loading assumed by the rolling element 204 may be transferred at least partially to the compliant retainer 214 and the biasing device 218, which may extend the service life of the rolling element assembly 200.

Figure 7:
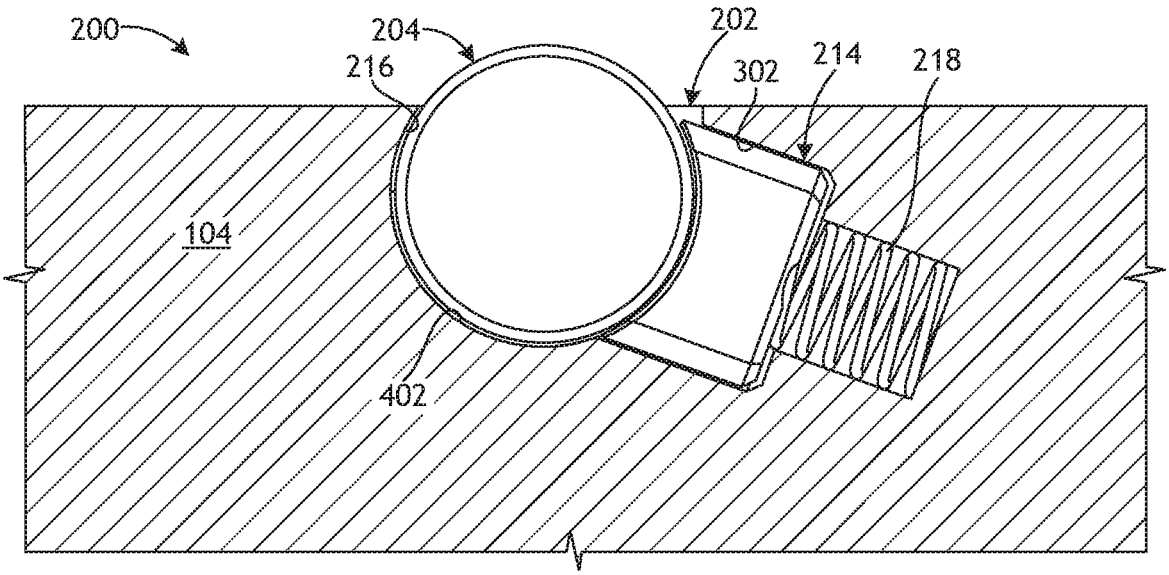
FIG. 7 is a partial cross-sectional side view of another embodiment of the rolling element assembly of FIG. 2.

FIG. 7 is a partial cross-sectional side view of another embodiment of the rolling element assembly 200 as installed within the cavity 202 defined in the blade 104. The illustrated embodiment is similar in some respects to the embodiment shown in FIG. 4. As illustrated, the compliant retainer 214 is arranged within the retainer slot 302 and the biasing device 218 acts on and urges the compliant retainer 214 against the outer circumference of the rolling element 204 to help maintain the rolling element 204 within the cavity 202.

Unlike the embodiment of FIG. 4, however, the cavity 202 in the embodiment of FIG. 7 includes a retention feature that also helps retain the rolling element 204 within the cavity. More specifically, the inner arcuate surface 402 of the cavity 202 opposite the retainer slot 302 may proceed in a continuous curved or arced trajectory until terminating at the opening 216. As a result, the compliant retainer 214 and a portion of the inner arcuate surface 402 at the opening 216 jointly encircle more than 180° of the circumference of the rolling element 204, but less than 360° and thereby retain the rolling element 204 within the cavity 202. Although the inner arcuate surface 402 provides an elongated continuous curved or arced surface as compared to the embodiment of FIG. 4, the length of the opening 216 remains larger than the diameter of the rolling element 204 to allow the rolling element 204 to enter.

Embodiments disclosed herein include:

A. A rolling element assembly that includes a rolling element rotatable about a rotational axis when positioned within a cavity defined on a bit body of a drill bit, a compliant retainer positioned within a retainer slot defined in the bit body, and a biasing device positioned within a device pocket defined within the bit body to bias the compliant retainer against the outer circumferential surface of the rolling element, wherein the compliant retainer secures the rolling element within the cavity while an arcuate portion of the rolling element protrudes from the cavity and exposes a full axial width of the rolling element.

B. A drill bit that includes a bit body including one or more blades extending therefrom, a plurality of cutters secured to the one or more blades, and a rolling element assembly positioned within a cavity defined on the bit body, the rolling element assembly including a rolling element rotatable within the cavity about a rotational axis and a compliant retainer positioned within a retainer slot defined in the bit body and biased against an outer circumferential surface of the rolling element, wherein the compliant retainer secures the rolling element within the cavity while an arcuate portion of the rolling element protrudes from the cavity and exposes a full axial width of the rolling element.

Each of embodiments A and B may have one or more of the following additional elements in any combination: Element 1: wherein at least the compliant retainer and the cavity cooperatively encircle more than 180° but less than 360° of a circumference of the rolling element. Element 2: wherein the biasing device causes formation of a gap between a back surface of the compliant retainer and a bottom of the retainer slot. Element 3: wherein the compliant retainer comprises a material selected from the group consisting of steel, a steel alloy, tungsten carbide, a sintered tungsten carbide composite, cemented carbide, polycrystalline diamond, thermally stable polycrystalline diamond, cubic boron nitride, impregnated diamond, nanocrystalline diamond, ultra-nanocrystalline diamond, zirconia, any derivatives thereof, and any combination thereof. Element 4: wherein the compliant retainer defines an inner arcuate surface having an upper extent that extends above a centerline of the rolling element when the rolling element is assembled in the cavity. Element 5: further comprising a bearing element positioned within a bearing slot defined in the bit body and having an inner arcuate surface engageable with the outer circumference of the rolling element. Element 6: further comprising a second biasing device positioned within a second device pocket defined within the bit body to bias the bearing element against the outer circumferential surface of the rolling element. Element 7: further comprising a locking pin that secures the compliant retainer within the retainer slot. Element 8: wherein the bit body defines a body aperture that penetrates the retainer slot and the compliant retainer defines a retainer aperture alignable with the body aperture, and wherein the locking pin is extendable into the body aperture and the retainer aperture. Element 9: wherein the retainer aperture is sized to allow the compliant retainer to translate within the retainer slot.

Element 10: wherein the cavity is defined on the one or more blades. Element 11: wherein the compliant retainer defines an inner arcuate surface having an upper extent that extends above a centerline of the rolling element when the rolling element is assembled in the cavity. Element 12: further comprising a bearing element positioned within a bearing slot defined in the bit body and having an inner arcuate surface engageable with the outer circumference of the rolling element. Element 13: further comprising a second biasing device positioned within a second device pocket defined within the bit body to bias the bearing element against the outer circumferential surface of the rolling element. Element 14: further comprising a locking pin extendable through a body aperture defined in the bit body to secure the compliant retainer within the retainer slot. Element 15: wherein the rolling element assembly is oriented on the bit body to exhibit a side rake angle ranging between 0° and 45° or a side rake angle ranging between 45° and 90°. Element 16: wherein the rolling element assembly is oriented on the bit body to exhibit a back rake angle ranging between 0° and 45°, thereby allowing the rolling element to operate as a cutter. Element 17: wherein the rotational axis of the rolling element lies on a plane that passes through a longitudinal axis of the bit body. Element 18: wherein the rotational axis of the rolling element lies on a plane that is perpendicular to a longitudinal axis of the bit body.

By way of non-limiting example, exemplary combinations applicable to A and B include: Element 5 with Element 6; Element 7 with Element 8; Element 8 with Element 9; Element 12 with Element 13;

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A rolling element assembly, comprising:

a rolling element rotatable about a rotational axis when positioned within a cavity defined on a bit body of a drill bit;

a bearing element positioned within a bearing slot defined in the bit body and having an inner arcuate surface engageable with an outer circumferential surface of the rolling element;

a compliant retainer positioned within a retainer slot defined in the bit body; and a biasing device positioned within a device pocket defined within the bit body to bias the compliant retainer against the outer circumferential surface of the rolling element, wherein the compliant retainer secures the rolling element within the cavity while an arcuate portion of the rolling element protrudes from the cavity and exposes a full axial width of the rolling element.

2. The rolling element assembly of claim 1, wherein at least the compliant retainer and the cavity cooperatively encircle more than 180° but less than 360° of a circumference of the rolling element.

3. The rolling element assembly of claim 1, wherein the biasing device causes formation of a gap between a back surface of the compliant retainer and a bottom of the retainer slot.

4. The rolling element assembly of claim 1, wherein the compliant retainer comprises a material selected from the group consisting of steel, a steel alloy, tungsten carbide, a sintered tungsten carbide composite, cemented carbide, polycrystalline diamond, thermally stable polycrystalline diamond, cubic boron nitride, impregnated diamond, nanocrystalline diamond, ultra-nanocrystalline diamond, zirconia, any derivatives thereof, and any combination thereof.

5. The rolling element assembly of claim 1, wherein the compliant retainer defines an inner arcuate surface having an upper extent that extends above a centerline of the rolling element when the rolling element is assembled in the cavity.

6. The rolling element assembly of claim 1, wherein the compliant retainer simultaneously operates as a retaining structure and as another bearing element.

7. The rolling element assembly of claim 1, further comprising a second biasing device positioned within a second device pocket defined within the bit body to bias the bearing element against the outer circumferential surface of the rolling element.

8. The rolling element assembly of claim 1, further comprising a locking pin that secures the compliant retainer within the retainer slot.

9. The rolling element assembly of claim 8, wherein the bit body defines a body aperture that penetrates the retainer slot and the compliant retainer defines a retainer aperture alignable with the body aperture, and wherein the locking pin is extendable into the body aperture and the retainer aperture.

10. The rolling element assembly of claim 9, wherein the retainer aperture is sized to allow the compliant retainer to translate within the retainer slot.

11. A drill bit, comprising:

a bit body including one or more blades extending therefrom;

a plurality of cutters secured to the one or more blades; and a rolling element assembly positioned within a cavity defined on the bit body, the rolling element assembly including a rolling element rotatable within the cavity about a rotational axis, a bearing element positioned within a bearing slot defined in the bit body and having an inner arcuate surface engageable with an outer circumferential surface of the rolling element, a compliant retainer positioned within a retainer slot defined in the bit body, and a biasing device positioned within a device pocket defined within the bit body to bias the compliant retainer against the outer circumferential surface of the rolling element, wherein the compliant retainer secures the rolling element within the cavity while an arcuate portion of the rolling element protrudes from the cavity and exposes a full axial width of the rolling element.

12. The drill bit of claim 11, wherein the cavity is defined on the one or more blades.

13. The drill bit of claim 11, wherein the compliant retainer defines an inner arcuate surface having an upper extent that extends above a centerline of the rolling element when the rolling element is assembled in the cavity.

14. The drill bit of claim 11, wherein the compliant retainer simultaneously operates as a retaining structure and as another bearing element.

15. The drill bit of claim 11, further comprising a second biasing device positioned within a second device pocket defined within the bit body to bias the bearing element against the outer circumferential surface of the rolling element.

16. A drill bit, comprising:

a bit body including one or more blades extending therefrom;

a plurality of cutters secured to the one or more blades; and a rolling element assembly positioned within a cavity defined on the bit body, the rolling element assembly including a rolling element rotatable within the cavity about a rotational axis, a compliant retainer positioned within a retainer slot defined in the bit body, and a biasing device positioned within a device pocket defined within the bit body to bias the compliant retainer against an outer circumferential surface of the rolling element, wherein the compliant retainer secures the rolling element within the cavity while an arcuate portion of the rolling element protrudes from the cavity and exposes a full axial width of the rolling element, and a locking pin extendable through a body aperture defined in the bit body to secure the compliant retainer within the retainer slot.

17. The drill bit of claim 11, wherein the rolling element assembly is oriented on the bit body to exhibit a side rake angle ranging between 0° and 45° or a side rake angle ranging between 45° and 90°.

18. The drill bit of claim 11, wherein the rolling element assembly is oriented on the bit body to exhibit a back rake angle ranging between 0° and 45°, thereby allowing the rolling element to operate as a cutter.

19. The drill bit of claim 11, wherein the rotational axis of the rolling element lies on a plane that passes through a longitudinal axis of the bit body.

20. The drill bit of claim 11, wherein the rotational axis of the rolling element lies on a plane that is perpendicular to a longitudinal axis of the bit body.

* * * * *